US005254014A

United States Patent [19]

Yagi et al.

[11] Patent Number: 5,254,014

[45] Date of Patent: Oct. 19, 1993

[54] MALE CONNECTOR

[75] Inventors: Sakai Yagi; Masanori Tsuji; Kimihiro Abe; Motohisa Kashiyama, all of Shizuoka, Japan

[73] Assignee: Yazaki Corporation, Japan

[21] Appl. No.: 834,218

[22] Filed: Feb. 12, 1992

[30] Foreign Application Priority Data

Feb. 12, 1991 [JP] Japan ..... 3-005255[U]

[51] Int. Cl.[5] ..... H01R 13/627

[52] U.S. Cl. ..... 439/353; 439/357

[58] Field of Search ..... 439/345, 350, 353, 354, 439/355, 357

[56] References Cited

U.S. PATENT DOCUMENTS

| | | | |
|---|---|---|---|
| 3,475,718 | 10/1969 | Hartz et al. | 439/357 |
| 3,721,939 | 3/1973 | Paugh | 439/354 |
| 4,602,831 | 7/1986 | Lockard | 439/354 X |
| 4,871,325 | 10/1989 | Maejima et al. | 439/353 |

FOREIGN PATENT DOCUMENTS 61-39877 3/1986 Japan .

*Primary Examiner*—Larry I. Schwartz
*Assistant Examiner*—Khiem Nguyen
*Attorney, Agent, or Firm*—Wigman, Cohen, Leitner & Myers

[57] ABSTRACT

Disclosed is a male connector to be fitted to a female connector having a fitting hood, a first terminal and a first engaging portion. The male connector is provided with a connector body fitted to the fitting hood, which connector body has a holding chamber to hold a second terminal to be fitted to the first terminal. An elastic lock arm is integrally formed on the connector body through a front supporting portion and a rear supporting portion in an inserting direction, and has a second engaging portion to engage the first engaging portion. An elastic bending portion intervenes between at least one of the front supporting portion and the rear supporting portion and the elastic lock arm and integrally connects at least one of the front supporting portion and the rear supporting portion with the elastic lock arm.

5 Claims, 5 Drawing Sheets

MALE CONNECTOR

BACKGROUND OF THE INVENTION

1. Field of the Invention

This invention relates to a male connector fitted into a fitting hood of a female connector, and in particular to a male connector having an elastic lock arm supported by a connector body through a supporting portion.

2. Description of the Prior Art

Referring to FIGS. 1 and 2, a conventional male connector 1 is provided with a connector body 5 fitted into a fitting hood 9 of a female connector 7 and having two terminal holding chamber 3, 3. An elastic lock arm 15 is integrally formed on the connector body 5 through two supporting portions 17, 18, and a engaging projection (engaging portion) 13 to engage the engaging opening (engaged portion) 11 is formed on the elastic lock arm 15. The engaging projection 13 is provided with an inclined face 13*a* on the front side in a inserting direction. A pressing portion 21 is also formed on the elastic lock arm 15.

The female connector 7 is provided with a housing 23 having two terminal holding chamber 25, 25, and with a fitting hood 9 having a rectangular engaging opening 11.

Female terminals (not shown) are held in the terminal holding chamber 3, 3 of the connector body 5 respectively. On the other hand, male terminals (not shown) are respectively held in the terminal holding chamber 25, 25 formed in the housing 23 of the female connector 7. The male terminals project inside of the fitting hood 9 of the female connector 7. The female terminals are fitted into the male terminals by fitting the male connector 1 into the female connector 7, so that the female terminals are electrically connected with the males terminals.

When the male connector 1 is inserted into the fitting hood 9 of the female connector 7 in a direction designated by an arrow X, the engaging projection 13 abuts against an opening edge 9*a* of the fitting hood 9 so that the lock arm 15 bends in a direction approaching the connector body 5 as shown in FIG. 2B. When the male connector 1 is inserted into the inner part of the fitting hood 9, the engaging projection 13 engages the engaging opening 11. Consequently, the elastic lock arm 15 return to former condition as shown in FIG. 2A. In this condition, the engaging projection 13 projects over a cancel line A. Thus, the male connector 1 is fitted into the fitting hood 9 of the female connector 7, so that the engaging projection 13 engages the engaging opening 11 to maintain the engaging condition.

In the case where the male connector 1 is drawn out from the fitting hood 9 in the condition that the male connector 1 is fitted into the fitting hood 9 of the female connector 7, the pressing portion 21 is pressed in a direction designates by an arrow Y. As a result, the elastic lock arm 15 is forced to be bent, so that the engaging projection 13 is drawn from the engaging opening 11 to cancel the engaging condition between the engaging projection 13 and the engaging opening 11. In this condition, the male connector 1 is drawn out from the fitting hood 9.

However, as shown in FIG. 2B, since both ends of the elastic lock arm 15 is supported by the connector body 5 through the rigid supporting portions 17, 18, a large force is required to bend the elastic lock arm 15 when pressing the pressing portion 21. For this reason, a cancelling force necessary to cancel the engaging condition between the engaging projection 13 and the engaging opening 11 is undesirably large.

In addition, there is a fear that the elastic lock arm 15 is unreasonably deformed more than the required amount by bending the elastic lock arm 15.

SUMMARY OF THE INVENTION

It is an object of the invention to provide a male connector which reduces a cancelling force necessary to cancel a engaging condition between a engaging portion and a engaging opening to prevent unreasonable deformation of a elastic lock arm.

This and other objects can be achieved according to the present invention by providing a male connector to be fitted to a female connector having a fitting hood, a first terminal and a first engaging portion, comprising:

a connector body fitted to the fitting hood, having a holding chamber to hold a second terminal to be fitted to the first terminal;

an elastic lock arm integrally formed on the connector body through a front supporting portion and a rear supporting portion in an inserting direction, having a second engaging portion to engage the first engaging portion; and an elastic portion intervening between at least one of the front supporting portion and the rear supporting portion and the elastic lock arm, integrally connecting at least one of the front supporting portion and the rear supporting portion with the elastic lock arm.

DETAILED DESCRIPTION OF THE PREFERRED EMBODIMENTS

Figure 1:
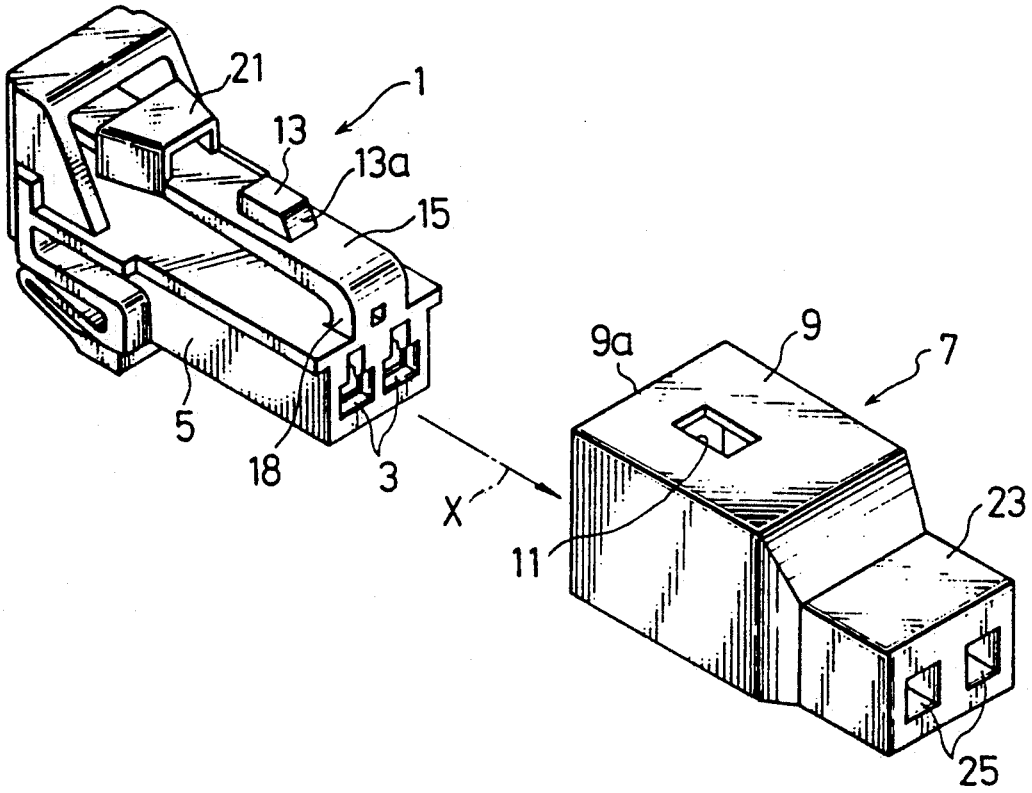
FIG. 1 PRIOR ART
FIG. 1 is a perspective view showing a conventional male connector fitted into a female connector.
Figure 2A:
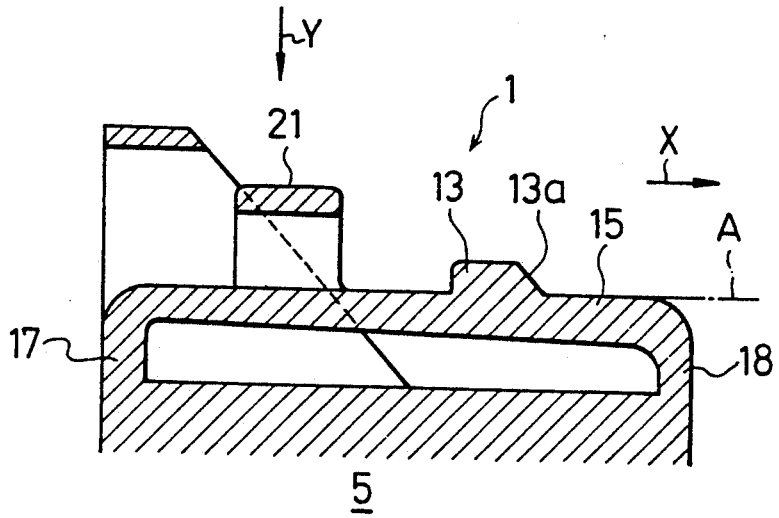
FIG. 2A PRIOR ART
FIG. 2A is a sectional view taken along in a longitudinal direction of the conventional male connector shown in FIG. 1.
Figure 2B:
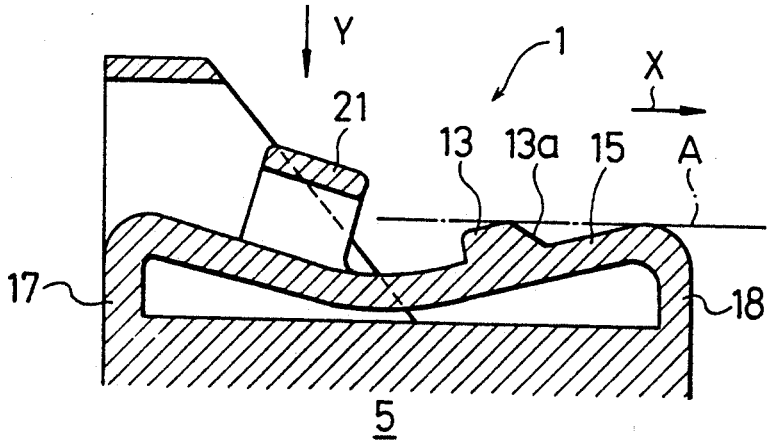
FIG. 2B PRIOR ART
FIG. 2B is a sectional view showing a condition that an elastic lock arm of the conventional male connector is bent.
Figure 3:
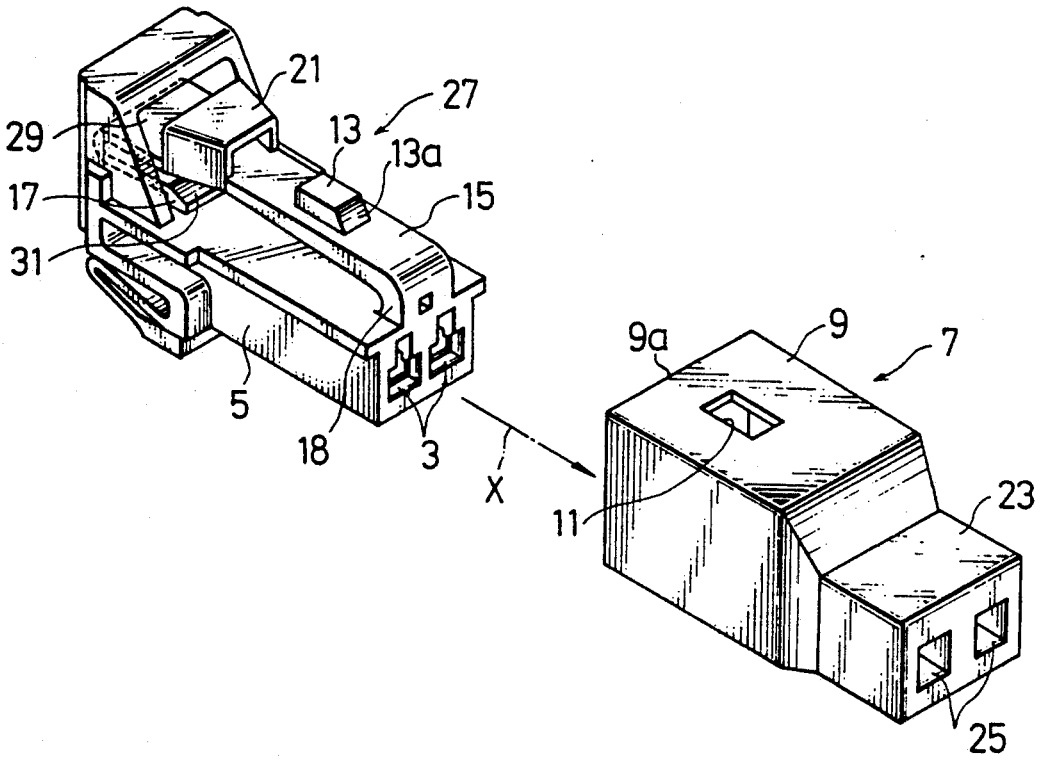
FIG. 3 is a perspective view showing a male connector according to the present invention fitted into a female connector.
Figure 4A:
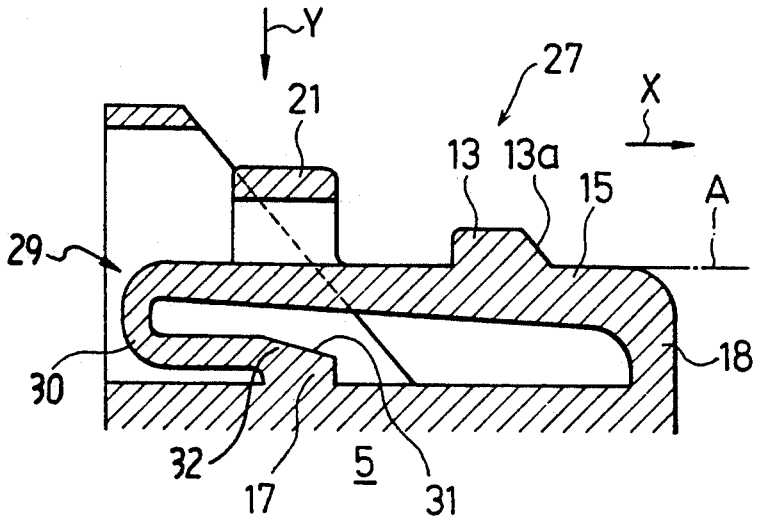
FIG. 4A is a sectional view taken along in a longitudinal direction of the male connector shown in FIG.3.
Figure 4B:
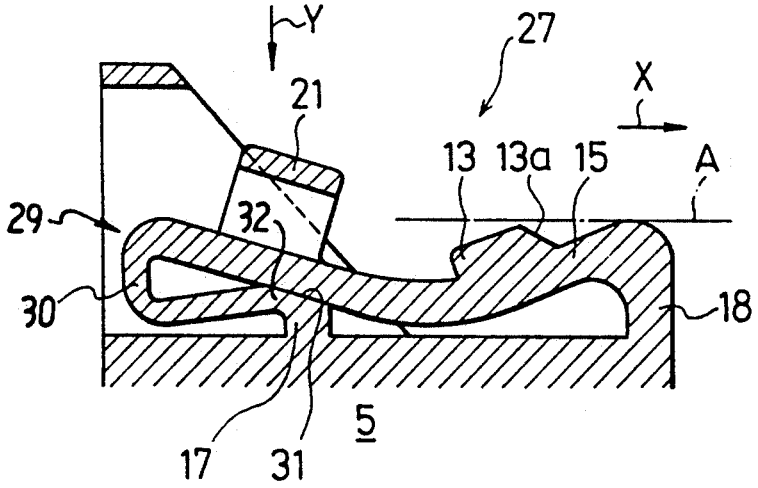
FIG. 4B is a sectional view showing a condition that an elastic lock arm of the male connector shown in FIG. 4A.

Referring FIGS. 3, 4A and 4B a male connector 27 is provided with a connector body 5 fitted into a fitting hood 9 of a female connector 7 and having two terminal holding chamber 3, 3. An elastic lock arm 15 is integrally formed on the connector body 5 through two supporting portions 17, 18, that is, a rear supporting portion 17 and a front supporting portion 18. The rear supporting portion 17 is arranged on the rear side in the inserting direction of the male connector 27 to the female connector 7 and the front supporting portion 18 is arranged on the front side in the inserting direction. The elastic lock arm 15 extends in the inserting direction. The front end of the elastic arm 15 is directly connected to the front supporting portion 18. The rear end of the elastic arm 15 is connected to the rear supporting portion 17 through an elastic bending portion 29. The elastic bending portion 29 is provided with a first bending section 30 which extends toward the rear end of the elastic lock arm 15 and then transitions to and connects with the front supporting portion 18. The rear supporting portion 17 is provided with an inclined receiving portion 31 for receiving the elastic lock arm 15. The receiving portion 31 is positioned on the convex side of a second bending section 32 located at the junction of the rear supporting portion 17 and the elastic bending portion 29. The receiving portion 31 abuts against the inner side of the elastic lock arm 15 to limit the amount of the deformation in the elastic lock arm 15.

An engaging projection (engaging portion) 13 to engage the engaging opening (engaged portion) 11 is formed on the elastic lock arm 15. The engaging projection 13 is provided with a inclined face 13*a* on the front side in the inserting direction. A pressing portion 21 is also formed on the elastic lock arm 15. The pressing portion 21 is preferably positioned over the receiving portion 31.

The female connector 7 is provided with a housing 23 having two terminal holding chamber 25, 25, and with a fitting hood 9 having a rectangular engaging opening 11.

Female terminals (not shown) are held in the terminal holding chamber 3, 3 of the connector body 5 respectively. On the other hand, male terminals (not shown) are respectively held in the terminal holding chamber 25, 25 formed in the housing 23 of the female connector 7, which male terminals project inside of the fitting hood 9 of the female connector 7. The female terminals are fitted into the male terminals by fitting the male connector 1 into the female connector 7, so that the female terminals are electrically connected with the male terminals.

Next, the fitting method for fitting the male connector 27 into the fitting hood 9 of the female connector 7 and for drawing out the male connector 27 from the fitting hood 9 will be described hereinafter.

When the male connector 27 is inserted into the fitting hood 9, the inclined portion 13*a* of the engaging projection 13 abuts against the opening end 9*a* of the fitting hood 9. When the male connector 27 is further inserted into the fitting hood 9 from this condition, as shown in FIG. 4B, the elastic lock arm 15 bends. When the male connector 27 is completely inserted into the fitting hood 9, the engaging projection 13 engages the engaging opening 11 of the female connector 7. Thus, the male connector 27 is firmly fitted into the fitting hood 9 to maintain the fitting condition.

Next, in the case where that male connector 27 is drawn out from the fitting hood 9 from the condition that male connector 27 is fitted into the fitting hood 9, that is, the elastic lock arm 15 is in condition shown in FIG. 4A, the pressing portion 21 is pressed in the direction designated by an arrow Y to force to bend the elastic lock arm 15. In this time, since the elastic bending portion 29 is positioned on the rear side of the rear supporting portion 17 in the inserting direction, the elastic lock arm 15 is lengthen in appearance to make it possible to easily bend the elastic lock arm 15 by a little pressing force when bending the elastic lock arm 15. In addition, since the amount of the deformation in the elastic lock arm 15 is limited to a proper amount by the receiving portion 31 of the rear supporting portion 17, the unreasonable deformation of the elastic lock arm 15 is prevented.

Figure 5A:
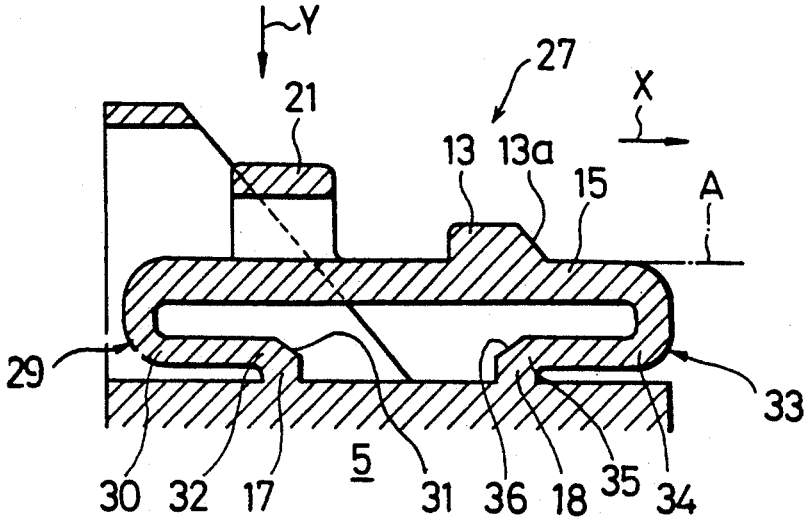
FIG. 5A is a sectional view taken along a longitudinal direction of the male connector of another embodiment having both front and rear bending portions.
Figure 5B:
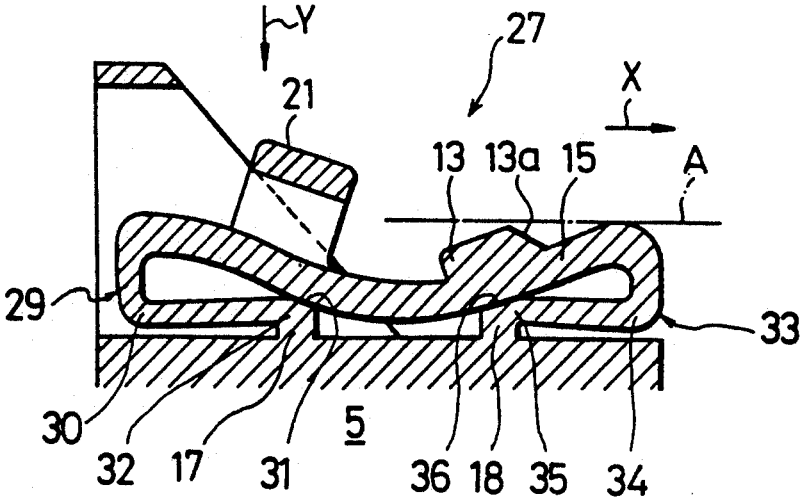
FIG. 5B is a sectional view of FIG. 5A showing the elastic lock arm in a bent condition.

When the elastic lock arm 15 is bent to the condition the inner side of the elastic lock arm 15 abuts against the receiving portion 31, the engaging projection 13 moves under the cancel line A to be disengaged from the engaging opening 11. In this condition, it is possible to draw out the male connector 27 from the fitting hood 9 by moving the male connector 27 in the direction reverse to the arrow X. In addition, in this embodiment the elastic bending portion 29 is formed between the rear supporting portion 17 and the rear end of the elastic lock arm 15, however, the elastic bending portion 29 may be formed between the front supporting portion 18 and the front end of the elastic lock arm 15. According to this second embodiment, shown in FIGS. 5A and 5B, the front end of elastic lock arm 15 is generally connected to the front supporting portion 18 through an elastic bending portion 33. More particularly, the elastic bending portion 33 is provided with a first bending portion 34 which extends from the front end of the elastic lock arm 15 and then along the connector body 5 and after that, is bent to meet the rear supporting portion 17 after transitioning through a rear elastic bending portion 29. A second bending portion 35 extends from the first bending portion 34 to the front supporting portion 18 and after that, is bent to the front supporting portion 18 formed on connector body 5.

The front supporting portion 18 is provided with an inclined receiving portion 36 for receiving the elastic lock arm 15. The receiving portion 36 is formed on the convex side of the second bending portion 35.

What is claimed is:

1. A male connector to be fitted to a female connector having a fitting hood, a first terminal and a first engaging portion, comprising:

a connector body fitted to said fitting hood, having a holding chamber to hold a second terminal to be fitted to said first terminal;

an elastic lock arm integrally formed on said connector body through a front supporting portion and a rear supporting portion in an inserting direction, having a second engaging portion provided on the respective supporting portion to engage said first engaging portion; and an elastic bending portion cantilevered from at least one of said front supporting portion and said rear supporting portion and said elastic lock arm, integrally connecting at least one of said front supporting portion and said rear supporting portion with said elastic lock arm said bending portion bending so as to position said elastic lock arm over at least one of said supporting portions.

2. The male connector according to claim 1, wherein said elastic bending portion is bent so as to position said elastic lock arm over said one of said front supporting portion and said one of said rear supporting portion.

3. The male connector according to claim 1, wherein at least one of said front supporting portion and said rear supporting portion, having a receiving portion for receiving said elastic lock arm.

4. The male connector according to claim 1, wherein said elastic bending portion provided with a first bending portion which extends from a rear end of said elastic lock arm to said connector body and, after that, is bent to said front supporting portion, and a second bending portion which extends from said first bending portion to said front supporting portion and, after that, is bent to said rear supporting position formed on said connector body.

5. The male connector according to claim 1, wherein said elastic bending portion provided with a first bending portion which extends from a front end of said elastic lock arm to connector body and, after that, is bent to said rear supporting portion, and a second bending portion which extends from said first bending portion to said rear supporting portion and, after that, is bent to said front supporting portion formed on said connector body.

* * * * *